US005377394A

United States Patent [19]

Fildan

[11] Patent Number: 5,377,394

[45] Date of Patent: Jan. 3, 1995

[54] LINGERIE CLASP

[76] Inventor: Gerhard Fildan, Kriehburgergasse 31, A-1050 Vienna, Austria

[21] Appl. No.: 172,031

[22] Filed: Dec. 22, 1993

Related U.S. Application Data

[63] Continuation-in-part of Ser. No. 4,039, Jan. 26, 1992, which is a continuation-in-part of Ser. No. 530,728, May 30, 1990, Pat. No. Des. 337,745.

[51] Int. Cl.[6] ..... A44B 11/00; A44B 21/00

[52] U.S. Cl. ..... 24/683; 24/684; 24/616; 24/590

[58] Field of Search ..... 24/683, 684, 685, 686, 24/654, 616, 615, 614, 586, 597, 590, 116 A, 265 EC, 265 H, 310, 321, 627; 63/2, 29.1

[56] References Cited

U.S. PATENT DOCUMENTS

| | | | |
|---|---|---|---|
| 317,984 | 5/1885 | Essig | 24/684 |
| 760,171 | 5/1904 | Atwell | 24/310 |
| 796,414 | 8/1905 | Chayes | 24/627 |
| 2,030,563 | 2/1936 | Barnes | 24/321 |
| 3,372,440 | 3/1968 | Burson, Jr. | 24/310 |
| 3,900,927 | 8/1975 | D'Angelo et al. | 24/597 |
| 4,000,544 | 1/1977 | Fildan . | |

FOREIGN PATENT DOCUMENTS

| | | | |
|---|---|---|---|
| 0018292 | of 1894 | United Kingdom | 24/684 |

*Primary Examiner*—Victor N. Sakran
*Attorney, Agent, or Firm*—Herbert Dubno

[57] ABSTRACT

A lingerie clasp has a male clasp member with a central projection and a pair of pins lodged in a female clasp member having projections straddling the projection of the male member and formed with channels receiving the pins thereof. The pins are narrower than the mouth slots of the channel to allow them to be inserted and withdrawn. On the face side of the clasp, spherical bulges are provided to ensure an aesthetic appearance of the closed clasp, e.g. in the form of pearls.

18 Claims, 3 Drawing Sheets

LINGERIE CLASP

CROSS REFERENCE TO RELATED APPLICATIONS

This application is a continuation-in-part of Ser. No. 29/004,039 filed Jan. 26, 1992 as a continuation-in-part application of Ser. No. 07/530,728 filed May 30, 1990, and now U.S. Pat. No. Des. 337,745 dated Jul. 27, 1993.

FIELD OF THE INVENTION

The present invention relates to a lingerie clasp and, more particularly, to a clasp for connecting two strap members of, for example, a brassiere, to enable the separation of the strap members.

BACKGROUND OF THE INVENTION

In U.S. Pat. 4,000,544, I have described a clasp assembly for brassieres or other items of lingerie in which two clasp members, generally describable as a male member and a female member, can be interconnected by rotation of the two members so that they are generally perpendicular to one another on insertion of the male member into the female member. When the two members are rotated into coplanarity, they lock together to secure the clasp. Each of these members can have a loop or eye receiving a respective strap and the clasp can be used wherever a portion of a garment must be released from another portion, e.g. for securing the two straps of a brassiere together, for securing a strap to a brassiere cup which is intended to be released for nursing purposes, or for securing two cups of a brassiere together in the case of a front closure.

In my U.S. Pat. No. Des. 337,745, I have shown a slide-type lingerie buckle to which parts of a strap can be connected and serves as a link. This decorative link, which can be referred to as a three-pearl link because of the nature of the design, is not separable.

In the parent application, Ser. No. 29/004,039 filed Jan. 26, 1993, I have illustrated a clasp which is capable of separation and use in the manner of the clasp of U.S. Pat. No. 4,000,544.

In these earlier systems, while the link and/or clasp was capable of providing aesthetic and effective connection of straps, there has been a need for an improvement with respect to the tensile strength to which the article can be subject.

OBJECTS OF THE INVENTION

It is, therefore, the principal object of the present invention to provide an improved clasp for an item of lingerie and especially a brassiere, which has the improved aesthetic effects of the design application and patent set forth above but which has improved tensile strength over clasps hitherto used for similar purposes.

Still another object of the invention is to provide an improved clasp for the straps of a lingerie garment which is devoid of drawbacks of prior art clasps and is simple to open and close, but capable of affording high tensile strength.

SUMMARY OF THE INVENTION

These objects and others which will become apparent hereinafter are attained, in accordance with the invention in a lingerie clasp which comprises:

a female clasp member comprising:

a body formed with an elongated loop adapted to receive a first strap, the loop having an inner and an outer bar, a pair of spaced-apart projections extending laterally from the inner bar and provided with generally spheroidal formations on a face side and with aligned channels on a reverse side, the channels each having an open end turned toward the other channel, the channels each opening at a slot narrower than a width of the respective channel over an entire length thereof, and means bridging across ends of the channels opposite the open ends for increasing a tensile strength of the clasp; and a male clasp member comprising:

a body formed with an elongated loop adapted to receive a second strap, the loop of the male clasp member having an inner and an outer bar, a projection extending laterally from the inner bar of the male clasp member centrally thereof and provided with a spheroidal formation on a face side, a pair of pins extending in opposite directions from the projections parallel to the inner bar of the male clasp member and receivable in the channels, the pins having widths accommodatable in the channels and greater than widths of the slots in a plane of the pins and the loop of the male clasp member, the pins having widths in a direction perpendicular to the plane less than the widths of the slots, whereby the pins of the male clasp member are insertable through the slots from the reverse side of the female clasp member with the clasp member being located at a right angle to one another and the clasp members are locked together upon relative rotation of the clasp members into coplanarity with the spheroidal formations being aligned on the face sides along the axis of the pins.

According to a feature of the invention the spherical formations are all of approximately the same diameter and the spherical formations of the female clasp member are spaced apart by slightly less than a diameter of the spherical formation of the male clasp member.

The inner and outer bars of the loops can be mutually parallel according to a feature of the invention and each of the projections can be joined to the respective inner bar by at least one fillet.

The male clasp member can be provided with a pair of bumps spaced apart on opposite sides of the projection of the male clasp member and engageable with shoulders of the projections of the female clasp member when the latter is swung into substantial coplanarity with the male clasp member to limit rotation of the clasp members about the axis of the pins.

While the face and reverse sides of the loops can lie in mutually parallel planes, for increased tensile strength it is advantageous to make the inner bar of each loop thicker than the outer bar so that the face and reverse sides lie in planes which converge outwardly. The clasp members are molded from a synthetic resin material, preferably by injection molding.

The fact that both ends of the channels in which the pins of the male member are received, are bridged, either to completely close the distal ends or simply to bridge over holes communicating the channels, has been found to be of major importance in improving the tensile strength which the fastener can withstand, even by comparison with the fastener of my U.S. Pat. No. 4,000,544.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
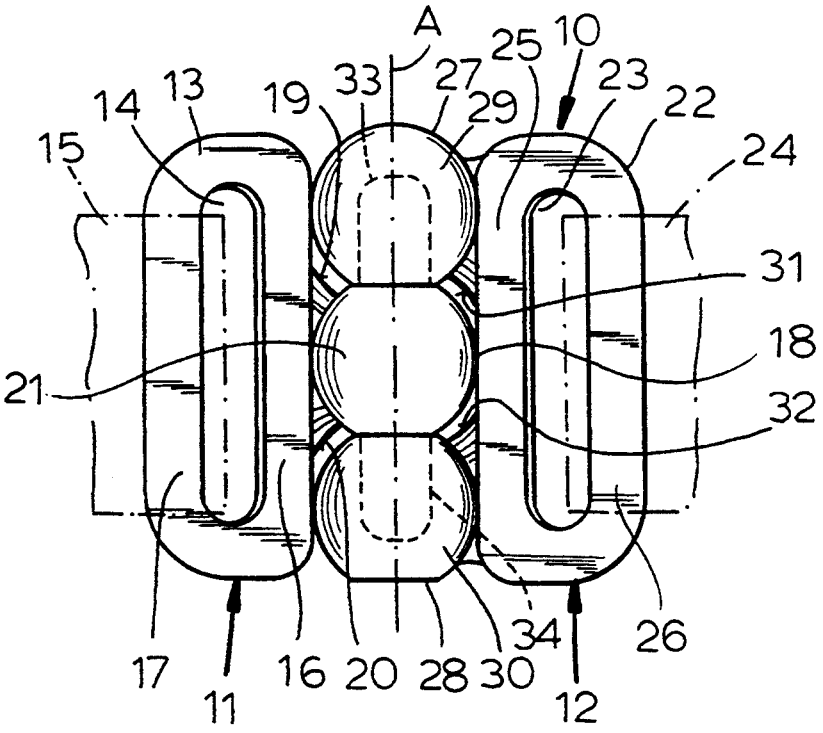
FIG. 1 is an elevational view from the face side of the clasp of the invention with the two clasp members engaged with one another.

As can be seen from FIG. 1, a lingerie clasp 10 according to the invention can comprise a male member 11 and a female member 12 which can be interfitted as will be described in greater detail below.

The male member 11 comprises a molded body formed with a loop 13 which is elongated and has a window 14 through which one strap 15 of the garment can pass. The window 14 is defined between an inner bar 16 and an outer bar 17, the bars being parallel to one another. The strap 15 can be bent around the outer bar 17 and stitched to itself or provided with a buckle as is well known in the lingerie and, especially, in the brassiere arts.

Laterally projecting from the inner bar 16 is a projection 18 connected by fillets 19 and 20 with the inner bar 16 and located substantially midway along the length of the inner bar 16. The spherical formation 21 is formed on the projection 18 on the face side of the clasp turned toward the viewer.

The female clasp member 12, similarly, is provided with a loop 22 having a window 23 through which the other strap 24 can pass and defined by an inner bar 25 and an outer bar 26, the strap 24 being looped around the outer bar. Unitarily with the synthetic resin molded body forming the female member are a pair of projections 27 and 28 with spheroidal formations 29 and 30 all of the same diameter as the spheroidal portion 21, but with a spacing less than this diameter so that, when the clasp members are interengaged and locked together, the spheroidal portions 21, 29 and 30 are in a single line and have the appearance of three pearls. The formations are closely juxtaposed with a minimum of clearance between the two formations of the female member and the formation of the male member disposed between them.

The formations 27 and 28 are connected by fillets 31 and 32 to the inner bar 25.

The male clasp member is provided in addition with a pair of pins 33 and 34 extending from the portion 21 parallel to the inner bar 16 and defining an axis A along which the spheroidal portions 21, 29, 30 are aligned.

Figure 2:
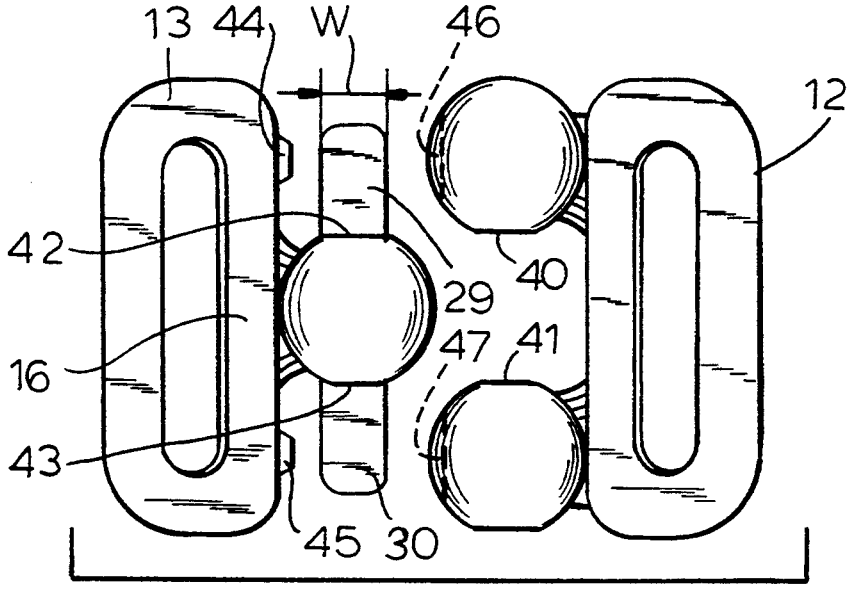
FIG. 2 is an exploded view showing the two clasp members separated from one another.
Figure 4:
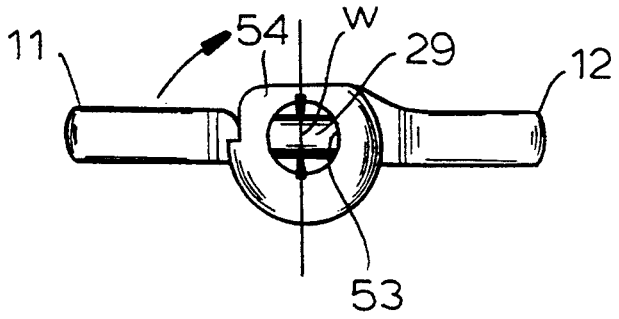
FIG. 4 is an end view of the clasp showing the hole and the bridge piece and illustrating the action in releasing the clasp.

As will be apparent from FIG. 2, in which the clasp members 11 and 12 are shown in their separated condition, the pins 29 and 30 have widths W in the plane of the pins and the respective loop 13. However, in the plane perpendicular to the plane of the paper in FIG. 2 (see FIG. 4, for example), the width w of the pin is substantially less.

As will be apparent from FIGS. 2 as well, the sides of the projections of the female clasp member facing one another are flattened or truncated at 40 and 41 while at the opposite sides the projection of the male clasp member, from which the pins project, are truncated by the flat surfaces 42 and 43. In addition, the inner bar 16 of the male closure member has a pair of pumps 44 and 45 which engage ledges 46 and 47 of the projections of the female closure member.

Figure 3:
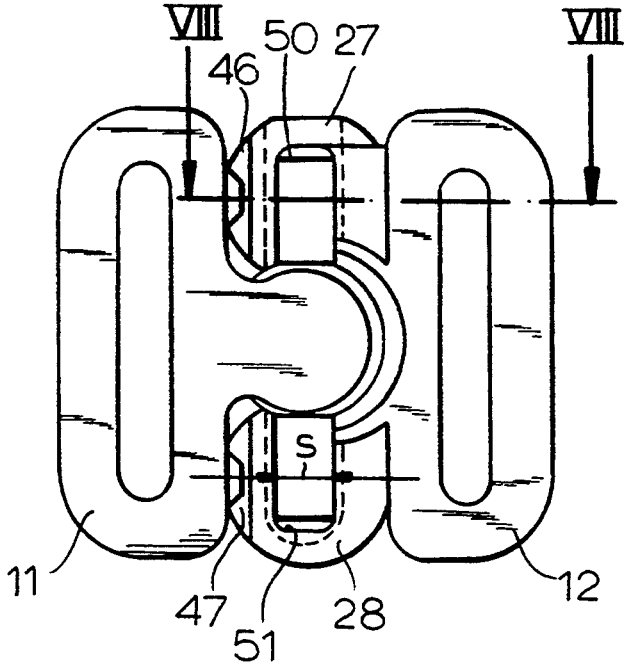
FIG. 3 is a view similar to FIG. 1 of the clasp from the reverse side.

Turning to FIG. 3, it will be apparent that the reverse side of the male member 11 is practically flat while the reverse sides of the projections 27 and 28 of the female member 12 has a pair of channels 50 and 51 adapted to accommodate the pins and opening at the reverse side at slots of a width s which is just slightly greater than w but less than W. Furthermore, the channels open unitarily toward the central formation of the male member in an axial direction. The undersides of the ledges 46 and 47 are visible in FIG. 3.

Figure 5:
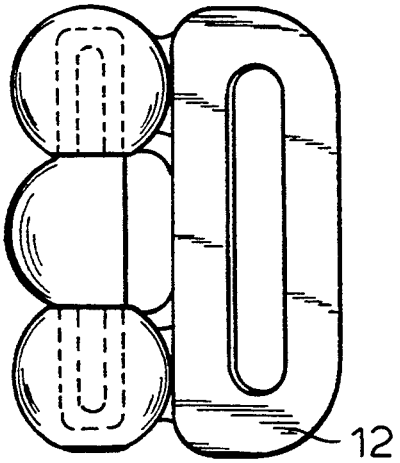
FIG. 5 is an elevational view of the clasp in which the male clasp member has been rotated to lie at a right angle to the female clasp member (behind the latter perpendicular to the plane of the paper in FIG. 5), preparatory to a separation of the clasp member.
Figure 7:
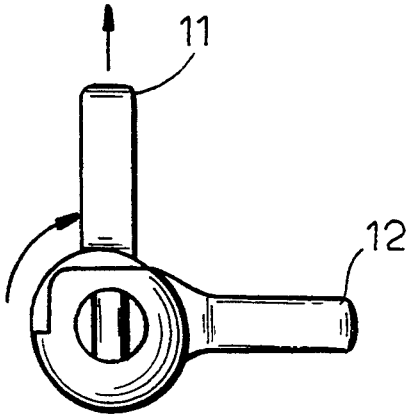
FIG. 7 is a view similar to FIG. 4 but showing the male clasp member swung through 90° to the female clasp member.

The male member 11 can be rotated (see FIG. 4) clockwise about the axis in the end view of this Figure so that the narrow cross section of the pins 29 and 30 can pass through the slot mouth to allow separation of the clasp members. In FIGS. 5 and 7 the clasp member 11 is shown at a right angle to the clasp member 12 enabling such separation.

Figure 6:
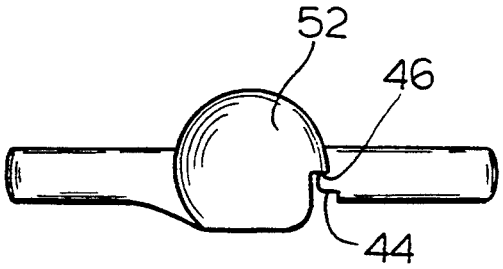
FIG. 6 is a view of the opposite end of the clasp from that shown in FIG. 4.

In FIG. 6, the clasp members are shown after the male member has been inserted into the female member and rotated to substantial coplanarity, the ledges 46, for example, engaging a pump 44 to prevent rotation of the clasp members relative to one another.

It is important to the present invention that the distal ends of the channels are bridged to increase the tensile strength of the clasp. Thus in FIG. 5 material of the molded female part can completely close the end of one channel at 52 while the other end of the opposite channel can be formed with a hole 53 bridged by a bridge piece 54.

Figure 8:
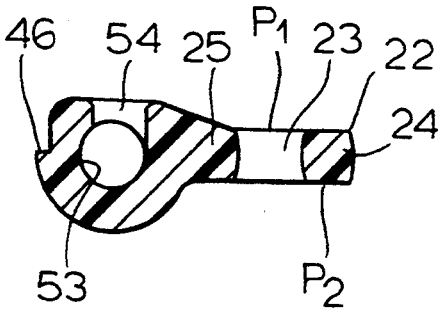
FIG. 8 is a cross sectional female clasp member generally as taken along the line VIII—VIII of FIG. 3 with, of course, the male clasp member removed.
Figure 9:
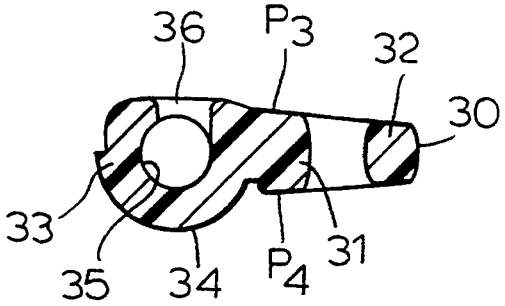
FIG. 9 is a cross sectional view similar to FIG. 8 with a slightly different construction to provide still further increased tensile strength for the clasp.

This bridge piece is shown in greater detail in the cross sectional view of FIG. 8 from which it will be apparent that the opposite sides of the loop 22 lie in planes $P_1$ and $P_2$ which are parallel to one another. By contrast, for greater tensile strength of the unit, the corresponding planes $P_3$ and $P_4$ of the loop 30 can converge outwardly, i.e. to the right. As a result, the inner bar 31 can be substantially thicker than the outer bar 32 and more material can connect it to the projection 33 having the spherical portion 34, the hole 35 and the bridge piece 36. The device of FIG. 9, therefore, is better able to resist tensile forces.

I claim:

1. A lingerie clasp comprising:

a female clasp member comprising:

a body formed with an elongated loop adapted to receive a first strap, said loop having an inner and an outer bar, a pair of spaced-apart projections extending laterally from said inner bar and provided with generally spheroidal formations on a face side and with aligned channels on a reverse side, said channels each having an open end turned toward the other channel, said channels each opening at a slot narrower than a width of the respective channel over an entire length thereof, and means bridging across ends of said channels opposite said open ends for increasing a tensile strength of the clasp; and a male clasp member comprising:

a body formed with an elongated loop adapted to receive a second strap, said loop of said male clasp member having an inner and an outer bar, a projection extending laterally from said inner bar of said male clasp member centrally thereof and provided with a spheroidal formation on a face side, a pair of pins extending in opposite directions from said projections parallel to said inner bar of said male clasp member and receivable in said channels, said pins having widths accommodatable in said channels and greater than widths of said slots in a plane of said pins and the loop of said male clasp member, said pins having widths in a direction perpendicular to said plane less than the widths of said slots, whereby said pins of said male clasp member are insertable through said slots from the reverse side of said female clasp member with said clasp member being located at a right angle to one another and said clasp members are locked together upon relative rotation of said clasp members into coplanarity with said spheroidal formations being aligned on the face sides along an axis of said pins.

2. The clasp defined in claim 1 wherein said spherical formations are all approximately of the same diameter.

3. The clasp defined in claim 1 wherein said spherical formations of said female clasp member are spaced apart by slightly less than a diameter of the spherical formation of said male clasp member.

4. The clasp defined in claim 1 wherein the inner and outer bars of said loops are mutually parallel.

5. The clasp defined in claim 1 wherein each of said projections is joined to the respective inner bar by at least one fillet.

6. The clasp defined in claim 1 wherein said male member is provided with a pair of bumps to opposite sides of said projection from the inner bar of said loop of said male clasp member, said projections of said female clasp member having shoulders engaging said bumps to limit rotation of said clasp members about said axis.

7. The clasp defined in claim 1 wherein said means bridging across said ends includes a web of material closing one of said ends of one of said channels and a bridgepiece across a hole at the end of the other of said channels.

8. The clasp defined in claim 1 wherein said face and reverse sides of said loops lie in mutually parallel planes.

9. The clasp defined in claim 1 wherein said face and reverse sides of said loops lie in planes converging outwardly.

10. The clasp defined in claim 1 wherein said members are each molded in one piece from a synthetic resin material.

11. The clasp defined in claim 10 wherein said spherical formations are all approximately of the same diameter.

12. The clasp defined in claim 11 wherein said spherical formations of said female clasp member are spaced apart by slightly less that a diameter of the spherical formation of said male clasp member.

13. The clasp defined in claim 12 wherein the inner and outer bars of said loops are mutually parallel.

14. The clasp defined in claim 13 wherein each of said projections is joined to the respective inner bar by at least one fillet.

15. The clasp defined in claim 14 wherein said male member is provided with a pair of bumps to opposite sides of said projection from the inner bar of said loop of said male clasp member, said projections of said female clasp member having shoulders engaging said bumps to limit rotation of said clasp members about said axis.

16. The clasp defined in claim 15 wherein said means bridging across said ends includes a web of material closing one of said ends of one of said channels and a bridgepiece across a hole at the end of the other of said channels.

17. The clasp defined in claim 16 wherein said face and reverse sides of said loops lie in mutually parallel planes.

18. The clasp defined in claim 16 wherein said face and reverse sides of said loops lie in planes converging outwardly.

* * * * *